US005647593A

United States Patent [19]

Kamat et al.

[11] Patent Number: 5,647,593

[45] Date of Patent: Jul. 15, 1997

[54] EASY CHESS-LIKE GAME

[76] Inventors: Balkrishna Dattatray Kamat; Asha Balkrishna Kamat, both of 24 Faulkner St, Blackburn South, Victoria 3130, Australia

[21] Appl. No.: 669,535

[22] PCT Filed: Feb. 27, 1995

[86] PCT No.: PCT/AU95/00101

§ 371 Date: Jul. 15, 1996

§ 102(e) Date: Jul. 15, 1996

[87] PCT Pub. No.: WO95/23635

PCT Pub. Date: Sep. 8, 1995

[30] Foreign Application Priority Data

Mar. 4, 1994 [AU] Australia ..... PM4211
Nov. 15, 1994 [AU] Australia ..... 78831/94

[51] Int. Cl.[6] ..... A63F 3/02

[52] U.S. Cl. ..... 273/261

[58] Field of Search ..... 273/260, 261, 273/255, 262

[56] References Cited

U.S. PATENT DOCUMENTS

| | | | |
|---|---|---|---|
| 4,256,309 | 3/1981 | McQuillan | 273/261 X |
| 5,421,582 | 6/1995 | Ritter | 273/261 |
| 5,492,332 | 2/1996 | Hessnice | 273/261 |
| 5,513,849 | 5/1996 | Navin | 273/261 |

FOREIGN PATENT DOCUMENTS

| | | | |
|---|---|---|---|
| 8606975 | 12/1986 | WIPO | 273/261 |

*Primary Examiner*—William E. Stoll

[57] ABSTRACT

A chess-like game for two players, with a modified game board and a small number of playing pieces, in order to make it easy to learn and play and yet retain much of the appeal of the conventional chess game, in terms of strategy and tactics. In the preferred embodiment of the game, Pawns and Kings are completely eliminated, and a piece called Prince is used with a subset of conventional chess pieces. The Prince is allowed the moves of Rook, Bishop or Knight. The board is divided into Safety, Combat, Neutral and Waiting zones, and the method of playing the game is disclosed. Other embodiments are similar, although the types of pieces used and some of the rules employed differ somewhat from the preferred embodiment.

11 Claims, 8 Drawing Sheets

EASY CHESS-LIKE GAME

TECHNICAL FIELD

The present invention relates in general to chess-like games, and in particular to a simplified version of the chess game suitable to novices, children and a large section of the general public who find the game of chess too difficult, or too slow to learn and play.

BACKGROUND ART

Chess is an ancient game which has fascinated people interested in it for many generations. It has been suggested by researchers that chess originated in India in the sixth century AD, and entered Europe via Persia.

Over a period, many people have devised new games based on the concepts of chess, so as to provide new variations or to make the game simpler.

Examples of some of these variations can be seen in U.S. Pat. Nos. 4,093,237 to Weiss, 5,275,414 to Stephens et al, and 5,306,017 to Huston. However, none of these and other similar inventions seem to be easier versions of chess. In fact, many of these games appear to be more complex than the conventional game of chess.

U.S. Pat. No. 5,257,787 to Miccio is an attempt to simplify the game of chess, wherein both the size of the board and the number of pieces have been reduced. Nevertheless, due to the existence of the Pawns and the King, the main drawbacks of chess have not been overcome completely, viz. slowness of the game, low mobility of pieces, and complexity of the game.

One of the objects of the present invention is to provide a simple as well as quick version of chess, wherein the essence of the strategic and tactical aspects of the game are preserved.

DISCLOSURE OF INVENTION

The present invention is an easier variation of the chess game, wherein the modified game board with fewer playing pieces makes it possible for two players to enjoy a quick game, while appreciating the strategic and tactical aspects of chess.

In order to make the game simple and quick, the Pawns and Kings are eliminated completely in the preferred embodiment of the game. In chess, the Pawns are the least mobile pieces and further, they hamper the movement of other pieces. The King on the other hand is slow, needs to be protected at all times, and is, in a sense, a burden on the game.

The present invention makes use of special concepts such as Neutral and Safety zones, so as to stop the opposing pieces from attacking each other right from the start. In conventional chess, the Pawns provide a form of buffer.

In the preferred embodiment of the invention, a new playing piece called the Prince is used, as also some new rules for the Knight and Bishop moves in specially designated areas. The purpose here is to create more interest, and more options. However, in other embodiments of the invention, only normal chess pieces and moves are employed.

It is perhaps worth stating that neither this invention, nor other similar inventions, could be expected to replace the royal game of chess itself, which will continue to enthrall its fans for generations to come. However, it is hoped that some of the players who find an interest in chess through the present invention, will one day learn to enjoy the game of chess itself.

MODES FOR CARRYING OUT THE INVENTION

The invention will now be described in detail. Since this game is based on the concepts of conventional chess, obvious rules of chess applying to this invention are not described, except when required for clarity. The chess terminology used has the same or similar meaning as in conventional chess, unless otherwise stated.

The preferred embodiment of the invention will first be described wth the help of the drawings. Other possible embodimets are discussed at the end of this section.

Figure 1:
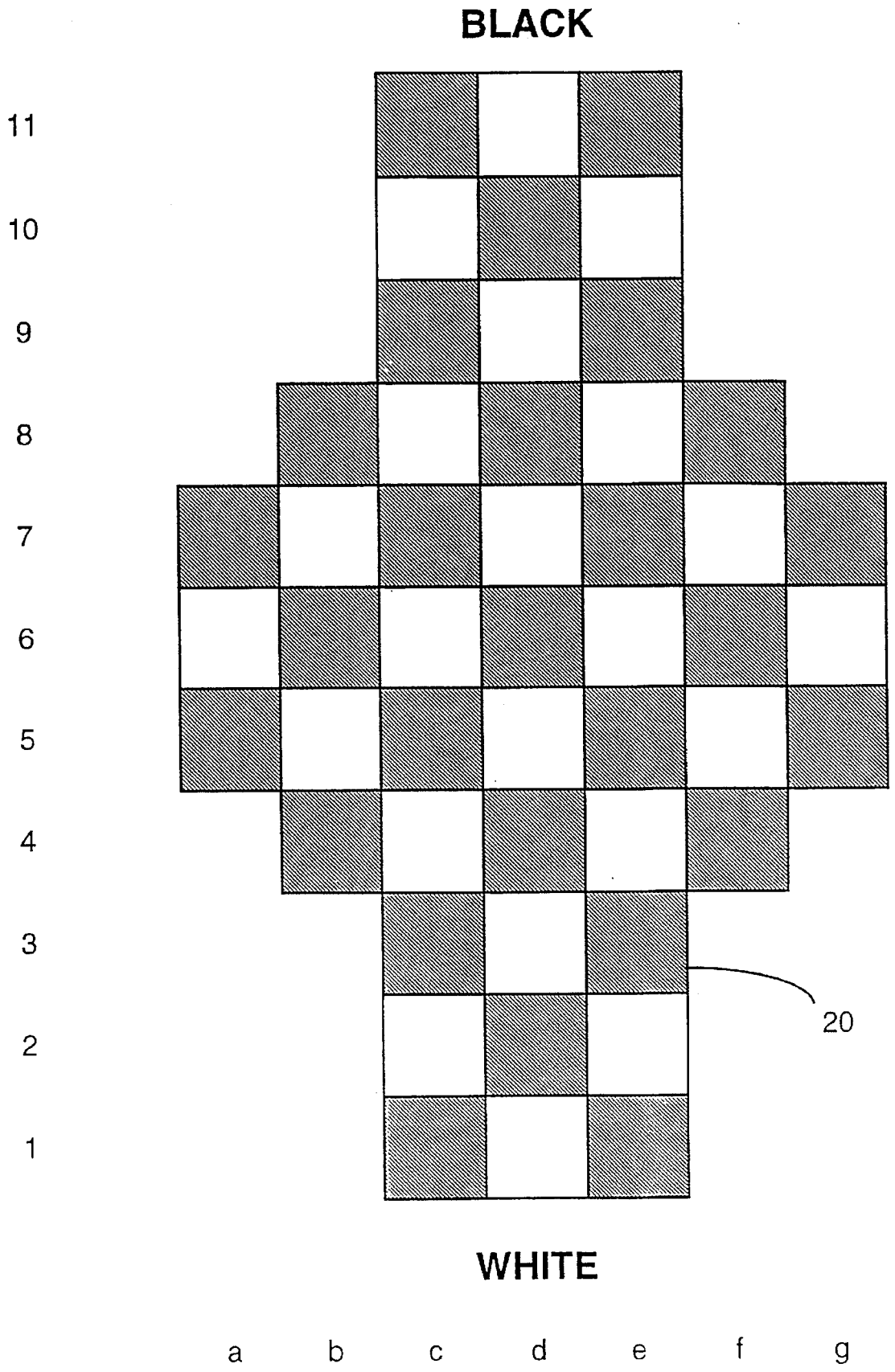
FIG. 1 shows a game board layout used with this invention.

The playing surface used for this chess-like game is shown in FIG. 1. Compared with conventionl chess board, this is a modified game board (20). It comprises alternate light and dark squares, which can be of different colors, arranged adjacently in vertical columns and horizontal rows. The squares are referred to as white and black as in conventional chess.

As can be observed, the playing surface of the game board has a specific shape. There are 7 vertical columns comprising a minimum of 3 and a maximum of 11 squares each, and 11 horizontal rows comprising a minimum of 3 and a maximum of 7 squares each. The game board comprises two square areas consisting of 9 squares each at the two ends of the board, and an area consisting of 31 squares located between them.

Further, specific areas of the playing surface have special significance. The game board comprises Safety zones, Combat zone, Neutral zone and Waiting zone, which are explained later on.

The game is played by two players from opposite sides of the board, named White and Black as in conventional chess, with two sets of playing pieces (one set for each player). Each set is distinguishable from the other. One set is light in color and the other dark, and they may use different colors.

Also, similar to the notation used in chess, the vertical columns have been assigned letters a through g; these are also called files. Similarly, the horizontal rows, also called ranks, have been numbered 1 through 11. This is for ease of reference. Each square in the playing surface can now be referred to by using a letter and a number.

Figure 2:
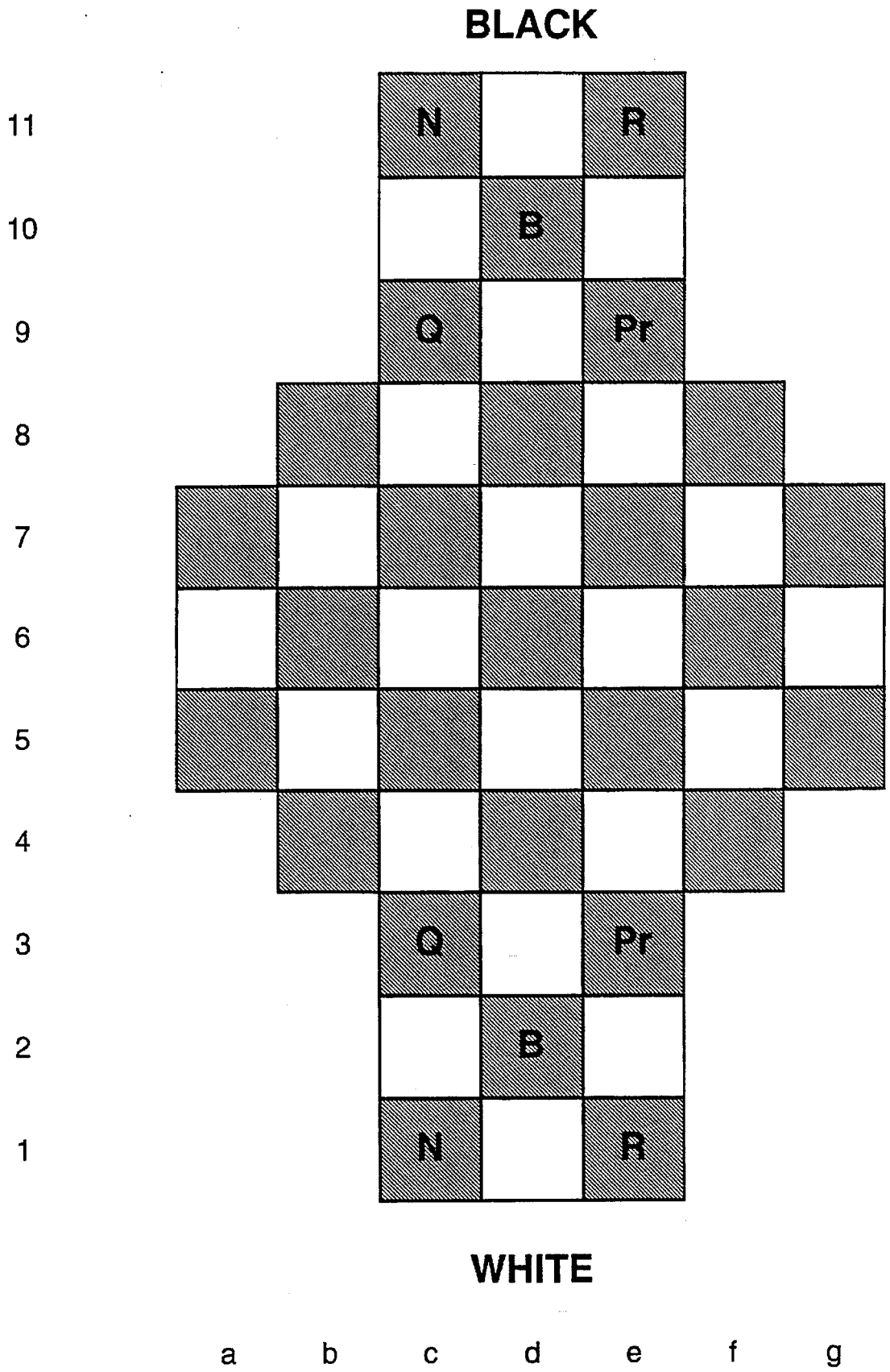
FIG. 2 shows the same game board with the initial position of the playing pieces used by each player, in the preferred embodiment of the game.

Referring to FIG. 2, each player is allocated a set of 5 playing pieces: a Queen (Q), a Prince (Pr), a Bishop (B), a Knight (N) and a Rook (R). These are initially located on the squares as shown. The pieces move according to rules of conventional chess, except otherwise noted below. The Prince, which is not a standard chess piece, can move like a Rook, Bishop or Knight, as described later. Other pieces are a subset of the conventional set of chess pieces, and move according to the rules of chess, with constraints imposed by the board used, unless otherwise specified below.

White makes the first move, and then alternate moves are made by the opponents as in conventional chess, the object being to progressively move one's pieces into the Combat zone and capture the opponent's pieces until a win or draw is agreed.

The board has a Combat zone defined by the files (columns) b to f, and ranks (rows) 4 to 8, excluding the squares b4, b8, f4 and f8. This is the main play area, and opponent's pieces can be captured in this area only.

The nine squares c1–c3, d1–d3, e1–e3, designated as White's Safety zone, are for exclusive use of White only. White may move his/her pieces within these squares, and Black is not allowed to enter this area. Once a piece has been moved out of this Safety zone, it may not be moved back into it again. Similarly, the nine squares c9–c11, d9–d11 and e9–e11, designated as Black's Safety zone, are for exclusive use of Black only.

Pieces allocated to each player are adapted to be arranged within each player's Safety zone, in the initial position for the game. The number of playing pieces cannot exceed in number the number of squares in the Safety zone. Pieces may be moved within the Safety zone, using their defined moves, before moving them into the Combat zone.

Rank (row) 6 in the Combat zone is called the Neutral zone, which cannot be entered or crossed by a White or Black piece on its initial move to enter the Combat zone from the Safety zone. This rule, however, does not apply while entering the Combat zone from the Waiting zone described later.

A piece may not capture the opponent's piece during its initial entry into the Combat zone from outside this area. This means the squares already occupied by the opponent's (and, of course, one's own) pieces are not available for initial entry of a piece into the Combat zone.

Once a piece enters the Combat zone, it may not move out of this zone, until it is captured by the opponent.

The two squares b4 and f4 are designated as White's Night-spots, and are for use of White's Knight only. These can be entered by the White Knight (using normal Knight moves), from its Safety zone as an alternative way of entering the Combat zone. Once in the Night-spot, the Knight may subsequently move anywhere into the Combat zone using a Knight move; but it may not capture a piece in doing so, as this is the first move into the Combat zone. Similarly, the squares b8 and f8 are designated as Black's Night-spots.

To make it clearer, the Knight is allowed to move to any square within the Combat zone, including the Neutral zone, while moving out of a Night-spot using normal Knight moves. The Knight cannot be captured while it is in the Night-spot.

The two files a and g are designated as Bishop-gates. These are for use by Bishops only, as an alternative way of entering the Combat zone. The Bishop is allowed to move from the Safety zone to a square in these files, using normal Bishop moves, provided there are no pieces in its path, including the Night-spot. (In the preferred embodiment of the game, the White Bishop may move to a5 or g5 in this way, and the Black Bishop to a7 or g7). Once in the Bishop-gate, i.e. files a or g, a Bishop is allowed to move to any square in the Combat zone (including the Neutral zone) in a subsequent move, using normal Bishop moves. But it may not capture a piece while doing so, as this is its first move into the Combat zone.

In addition, while in the Bishop-gate, a Bishop is also allowed to move to another square within that file, provided its path is not obstructed by another Bishop. This counts as a move. A Bishop can change from the black squares to white squares, for example, in this way.

The Bishop cannot be captured while it is in the Bishop-gate.

The Night-spots and the Bishop-gates together comprise the Waiting zone.

The Prince may use any one of the moves of Rook, Bishop or Knight within the Safety zone or while entering the Combat zone from the Safety zone. Immediately after moving the Prince into the Combat zone, however, the player has to nominate which of these possible three types of moves the Prince will use for its next move. This option is also to be nominated at the end of each of the Prince's moves thereafter; it may be the same as before, or changed at that time. This option may also be exercised by a player in lieu of a move, provided it changes the option from the previously nominated one.

Figure 3A:
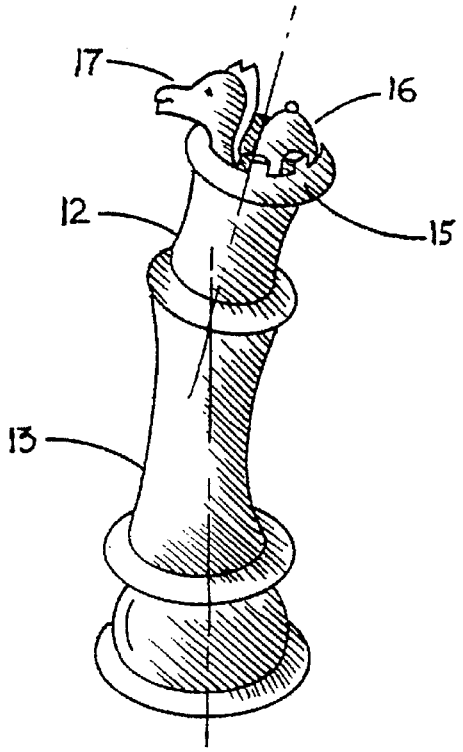
FIG. 3A shows one means of indicating a Rook, Bishop or Knight move for the playing piece called the Prince.
Figure 3B:
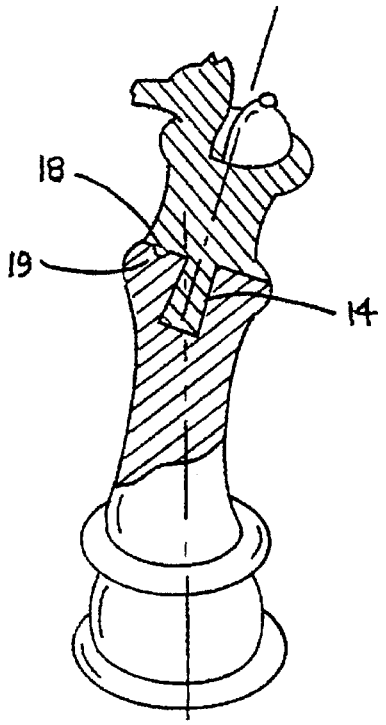
FIG. 3B shows a partial cut-away section to further illustrate this piece.

Special means of indication is provided with the Prince, in order to keep track of this choice at any time. The perspective views shown in FIGS. 3A and 3B illustrate one means of providing this indication. Here, a rotatable head 12 is fitted at an angle, over the shaft 13 of the piece, in order to move a different indication towards the top of the piece as required. The pin 14 on the head has a slight reverse taper so as to stop it from coming out once it is fitted into the corresponding hole in the shaft. In this arrangement, the head has indicia, so as to look partially like a Rook 15, Bishop 16, and Knight 17, and is turned on the shaft of the piece as required. Optionally, three small lugs, placed equidistant in a circle, on one part of the piece (illustrated by 18), and three corresponding dips on the other part (illustrated by 19), could facilitate locking in position, for each of the three options of this piece. It is also possible to design this piece in other ways. For example, the piece could be provided with two different colored vertical lines in front and at the back, so that the indicia aligned with the front line would indicate the option selected for the piece; the rotatable head would not need to be fitted at an angle over the shaft in this design.

Obviously other means of indication are possible. For example, the piece could have a set of removable hats, either color-coded or with indicia, so a different hat could be fitted on top of the piece, so as to indicate a different choice of moves. Yet another method would be to have battery and electronic components located inside the shaft of the piece, and a switching mechanism and light indicators on the body of the piece to provide such means of indication. The switching mechanism would activate the light indicators operated by the battery and the electronic components, through a known method.

The strategy in the game is to progressively move pieces from Safety zone into the Combat zone either directly, or by using the Night-spots (for the Knight), or the Bishop-gates (for the Bishop). The game proceeds by using the normal or special moves (as described) for the pieces, in order to capture the opponent's pieces, as in conventional chess. It is not necessary to move all the pieces out of the Safety zone for the game to proceed, or for the game to be completed.

Since there is no King in this game, the concept of 'check', as in conventional chess, does not apply. However, it is optional to consider the Queen to be in check, while under attack by a piece other than a Queen. But the Queen does not need to be saved in order for the game to continue.

Once a player has moved a piece into the Combat zone, the opponent must do so in the next move, unless he/she already has a piece in the Combat zone. This rule also applies after any capture, so that if a player has all his/her pieces previously in the Combat zone capured by the opponent, and does not immediately move a new one into that zone, that player loses the game.

The game is finished when the players agree on a draw or win. The recommended ending is when one or both players are left with two or less pieces on the board. At this stage, point values for each player's pieces are added up to decide on the outcome. The point values to be used are: Queen-9, Prince-7, Rook-5, Bishop-3 and Knight-3. However, if the player whose turn it is to play, even if left with 2 pieces or less, is able to capture a piece belonging to the opponent in the very next move, he/she has the option to complete such a move before the point values are added up. The other player is also then allowed to recapture a piece, at that stage, if it is possible to do so.

If no piece has been captured in 20 or more consecutive moves (for each player), then a point count as above may be demanded by one of the players, to decide on the outcome of the game, except that only the pieces in the Combat zone will qualify for the count in this instance.

If the same position on the board is repeated three or more times during the game, then a draw may be claimed by either player at that stage.

While the game is in progress, if the player whose turn it is to make the next move, is unable to make a legitimate move according to the rules of this game, then the game is considered to have ended in a stalemate, which is the same as a draw.

Each win is awarded one point, a draw equals half a point to each player. A number of games can also be played to decide on the over-all winner.

Two examples of this game are given below to illustrate the preferred embodiment of the game, using notations similar to those used with conventional game of chess. The moves of Prince (Pr) are followed in brackets by R, B or N, to indicate the option nominated for the next move of Prince.

EXAMPLE I

1.Qd4 Pre7(R) 2.Prd5(R) Re8 3.Re5 Prf7(B) 4.Prd7(R) Rxe5 5.Prxf7(R) Re8 6.Qd7 Qc8 7.Qxc8 Rxc8 8.Nd3 Ba7 9.Ne5 Bd4 10.Nd7 Rc7 11.Bg5 Bf6 12.Prxf6(N) Rxd7 13.Prxd7(R). White claims a win on the basis of point count of 10 for White against Black's 3, or on the basis that Black is unable to move a piece into the Combat zone in its very next move.

EXAMPLE II

1.Qc5 Prd8(R) 2.Nd3 Re8 3.Nb4 Bg7 4.Nc6 Prc8(R) 5.Qb5 Re6 6.Prc4(R) Qe9 7.Nd4 Prxc4(R) 8.Qxc4 Re4 9.Qd5 Qe7 10.Nc6 Qe8 11.Bg5 Nd9 12.Bg6 Nc7 13.Qd6 Be5 14.Nxe5 Qxe5 15.Qxe5 Rxe5 16.Bf7. The result is a draw, since the players are left with only two pieces each, and the point counts are equal, i.e. 8 points to each payer.

Whilst the preferred embodiment of the game has been described above, it will be appreciated by those skilled in the art that many modifications to this embodiment are possible within the concept of this invention. The invention is not to be considered limited to what is shown in the drawings and described in the specification.

Only some of the possible modifications to the preferred embodiment are highlighted below as examples. The same game board, playing pieces and rules used in the preferred embodiment are used in these modifications, except otherwise indicated. These embodiments are similar to the preferred embodiment, although some of the pieces, rules, and parts of the board may differ somewhat from the preferred embodiment. It can be seen that further combinations of the following modifications are also possible.

(a) Black is allowed to arrange its pieces in any fashion within the Safety zone. White then arranges its pieces the same way, as a mirror image, and makes its first move.

(b) Additional conventional chess pieces are used on the vacant squares within the Safety zone before starting a game. The playing pieces are allocated in equal numbers to each player. The number of playing pieces allocated to each player may not exceed the number of squares in the Safety zone.

(c) The Prince may be allowed the Rook, Bishop and Knight moves all the time, without having to nominate one of these beforehand.

Figure 4:
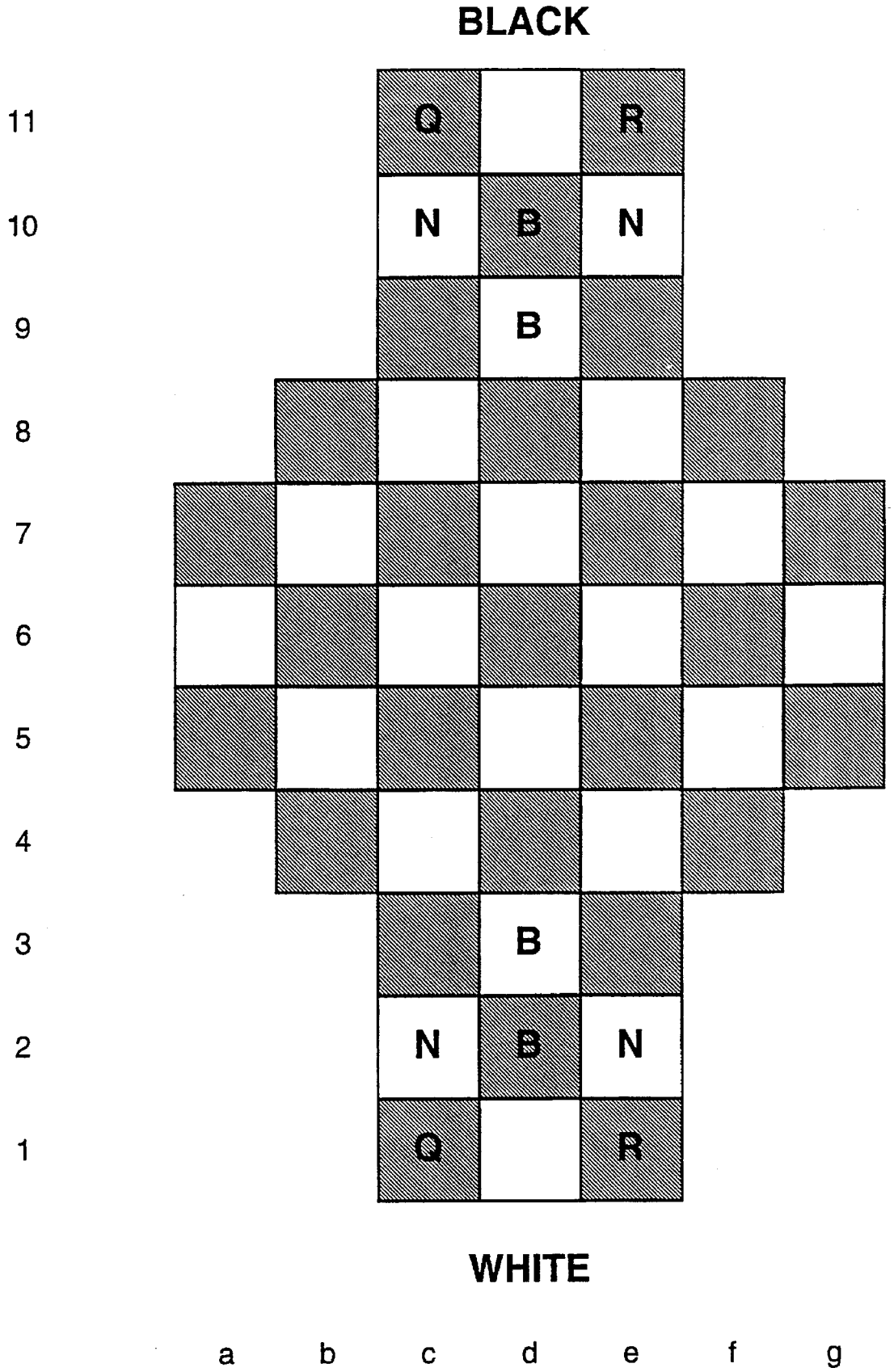
FIGS. 4, 5, 6, 7 and 8 show examples of possible other embodiments of the game.

(d) A selection of conventional chess pieces, excluding Pawns and Kings, is used instead of the pieces used in the preferred embodiment. An example of this is shown in FIG. 4.

Figure 5:
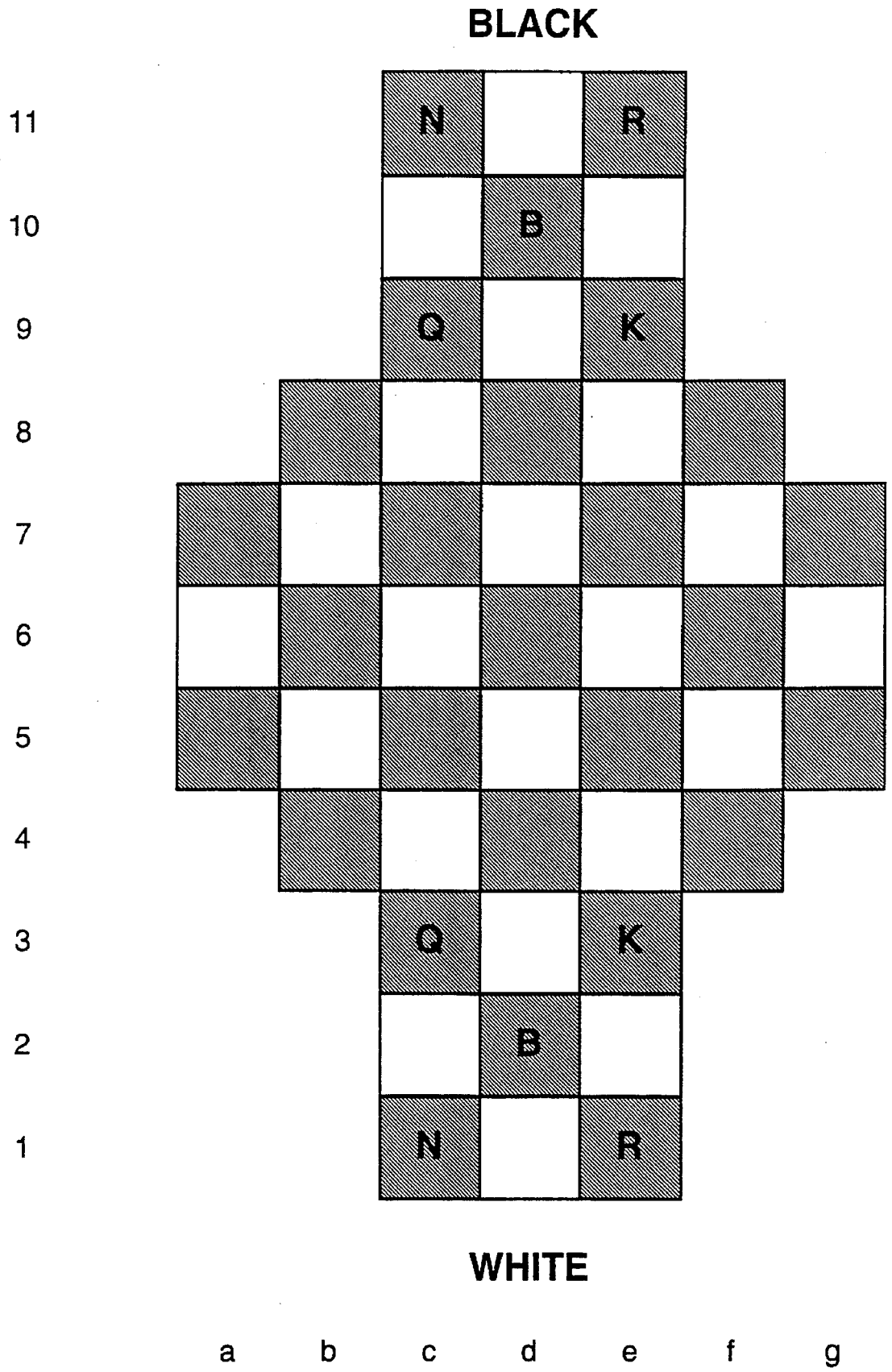

(e) The conventional chess King (K) is used in place of, or in addition to the Prince. FIG. 5 shows one such arrangement. Normal chess rules apply to the King, e.g. it can be 'checked'. Unless the King is checkmated or captured, the game ends when a player has two or less pieces left, as described in the preferred embodiment of the game. The King is assigned 3 points for the purposes of the point count.

In this variation, it is optional to allow 'castling' as follows: the King moves one square backward (e2 for White, and e10 for Black), and the Rook is moved to the square previously occupied by the King (e3 for White, and e9 for Black). Castling is only allowed if the King and Rook have not been moved previously, and the square between them is unoccupied. Castling counts as one move, as in conventional chess.

(f) All the squares in the rows 4 to 8 are treated as Combat zone, with or without the Night-spots and Bishop-gates being used. That is, the Night-spots and Bishop-gates, if used, will not have any special meaning, but will become part of the Combat zone. The concept of Neutral zone, as part of Combat zone, however, remains as before.

(g) Similar to the concept of the Prince, other new types of pieces can also be employed in addition to, or in place of the pieces described above. One of these pieces (called a Krook) is allowed to move like a Rook or Knight, and is constructed to appear partially like a Knight and partially like a Rook. Another piece (called a Bight), is allowed to move like a Bishop or Knight, and is constructed to appear partially like a Bishop and partially like a Knight. Otherwise, the game follows the same rules described in the preferred embodiment of the invention.

Figure 6:
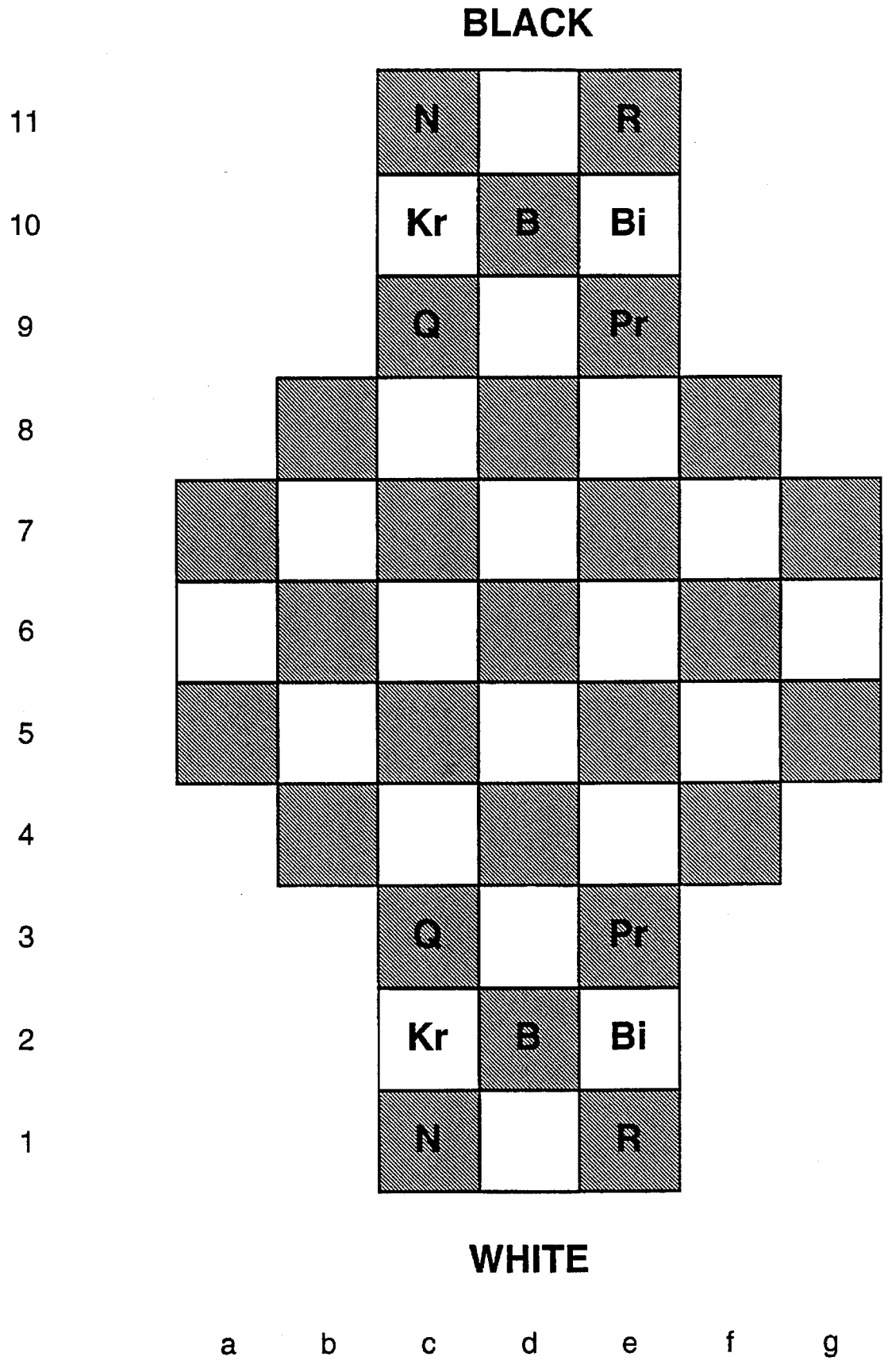

FIG. 6 shows an example of such an arrangement, where Kr indicates a Krook, and Bi indicates a Bight. The Krook is assigned 7 points, and the Bight 5 points, for the purposes of the point count.

Figure 7:
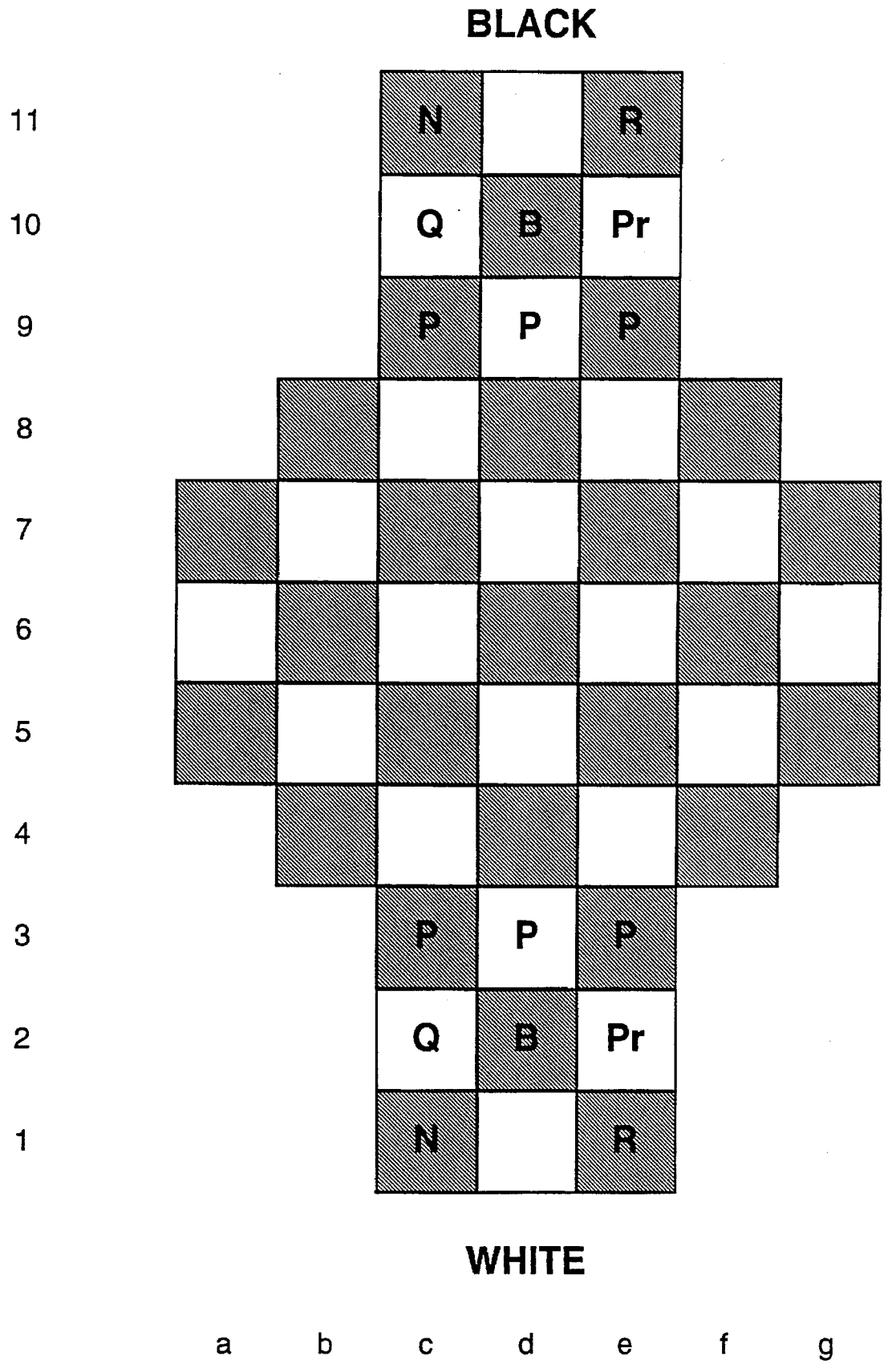

(h) Pawns are used in the front rows of the Safety zones (rows 3 and 9), and other selected pieces placed behind them. An example of this is shown in FIG. 7, where P indicates a Pawn. In this case, Pawns are allowed normal chess moves, and if they reach the opposite end of the Combat zone (rows 8 and 4 respectively for White and Black), they are to be replaced with any piece of the player's choice (other than a Pawn or King), similar to the ones employed in that game.

In this variation, the Pawn is allowed to move one or two squares forward in its first move (as in conventionl chess).

If it moves two squares, it can also be captured 'en passant' by the opponent's Pawn, if in appropriate position, as in conventional chess.

Pawns are allowed to move only within the Combat zone. The Pawn has a point value of 1 for the purposes of point count at the end of the game.

Figure 8:
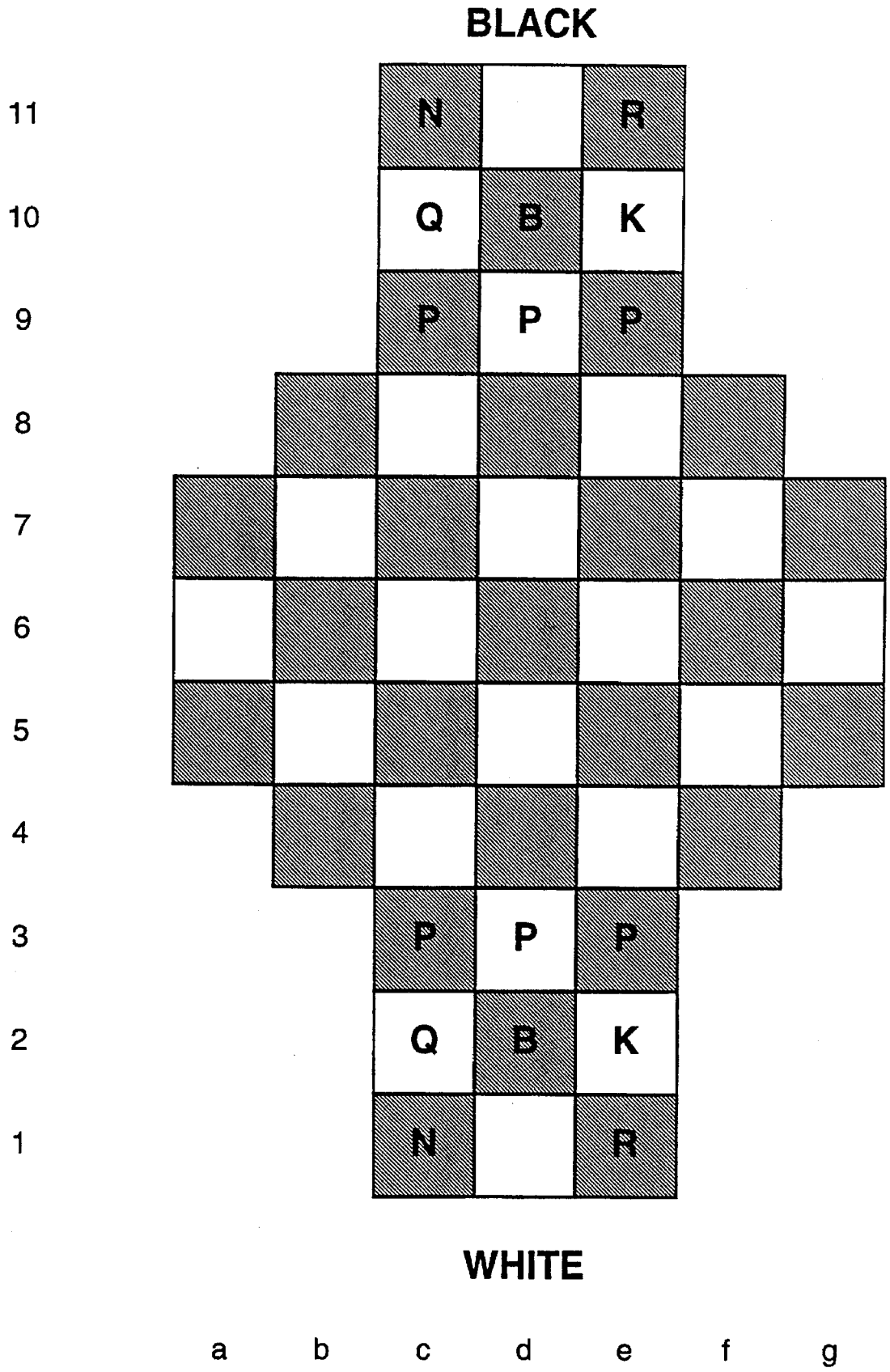

(i) FIG. 8 shows yet another variation of the game. Here, each set of playing pieces consists of a King, a Queen, a Rook, a Knight, a Bishop and three Pawns. All the squares in rows 4 to 8 comprise the Combat zone. That is, the squares previously designated as Waiting zone have no special meaning, and are available for Combat. Also, the Neutral zone has no special meaning, i.e. the pieces are allowed to move freely anywhere in the Combat zone; they may enter or cross the Neutral zone in their first move from the Safety zone. They may also capture the opponent's piece in their first move. The concept of the Safety zone, however, stands; i.e. the pieces cannot enter each other's Safety zones, and pieces moved out of the Safety zones may not enter the Safety zones again.

The rules governing the Pawns are similar to those described under (h) above; of course, the Combat zone available for the Pawns is larger. The rules governing the King are similar to those described under (e) above, except that castling is achieved by simply moving the King and Rook to the squares previously occupied by the other piece.

(j) The games described in this invention can also be played with time limits for each player, using clocks as in conventional chess games.

(k) The game board described in this invention can also have letters and numbers printed inside the squares (such as c1, c2 and the like) or along the edges of the game board to indicate the relative position of the squares on the game board. This is for ease of reference, especially to assist in recording the moves on paper as in conventional chess.

(l) Further, it is possible to alter the board described in this invention by altering the number of rows and/or columns so as to increase or decrease the Safety, Combat, Neutral and Waiting zones in terms of the number of squares created. This results in a variation of the same game, as the same principles described earlier apply.

INDUSTRIAL APPLICABILITY

There is commercial demand for new games. It is expected that the demand for a new simplified version of the chess game will be substantial. The present invention could be manufactured and marketed to meet such demand.

We claim:

1. A chess-like game for two players, comprising a game board (20) and a plurality of playing pieces, said game board comprising alternate light and dark squares arranged adjacently in 7 vertical columns and 11 horizontal rows, each of said vertical columns comprising a minimum of 3 and a maximum of 11 squares, each of said horizontal rows comprising a minimum of 3 and a maximum of 7 squares, said game board comprising two square areas consisting of 9 squares each, designated as Safety zones, at the two ends of the said game board and an area consisting of 31 squares, located between the said Safety zones, comprising a Waiting zone and a Combat zone having therein a Neutral zone, said Waiting zone comprising squares designated as Night-spots and Bishop-gates, said playing pieces comprising one set of light colored pieces and a set of dark colored pieces, adapted to be arranged within said Safety zones in the initial position for the game, each set comprising one Queen, one Prince, one Bishop, one Knight and one Rook, said Prince comprising means for indicating a choice of Rook, Bishop or Knight moves, said playing pieces not exceeding in number the number of squares in said Safety zones.

2. A chess-like game in accordance with claim 1, wherein said means for indicating a choice of Rook, Bishop or Knight moves comprises a rotatable head with indicia on it, fitted over a shaft.

3. A chess-like game in accordance with claim 1, wherein said means for indicating a choice of Rook, Bishop or Knight moves comprises removable hats which fit on top of said Prince.

4. A chess-like game in accordance with claim 1, wherein said means for indicating a choice of Rook, Bishop or Knight moves comprises a switching mechanism to activate light indicators operated by battery and electronic components.

5. A chess-like game in accordance with claim 1, wherein said playing pieces further comprise Krooks constructed to appear partially like a Knight and partially like a Rook.

6. A chess-like game in accordance with claims 1 or 5, wherein said playing pieces further comprise Bights, said Bights constructed to appear partially like a Bishop and partially like a Knight.

7. A chess-like game in accordance with claim 1, wherein said playing pieces further comprise Pawns.

8. A chess-like game for two players, comprising a game board (20) and a plurality of playing pieces, said game board comprising alternate light and dark squares arranged adjacently in 7 vertical columns and 11 horizontal rows, each of said vertical columns comprising a minimum of 3 and a maximum of 11 squares, each of said horizontal rows comprising a minimum of 3 and a maximum of 7 squares, said game board comprising two square areas consisting of 9 squares each, designated as Safety zones, at the two ends of said game board and an area consisting of 31 squares, located between the said Safety zones, comprising a Combat zone, said playing pieces comprising one set of light colored pieces and a set of dark colored pieces, adapted to be arranged within said Safety zones in the initial position for the game, each set consisting of one King, one Queen, one Rook, one Knight, one Bishop and three Pawns, said playing pieces not exceeding in number the number of squares in said Safety zones.

9. A chess-like game for two players, comprising a game board (20) and a plurality of playing pieces, said game board comprising alternate light and dark squares arranged adjacently in 7 vertical columns and 11 horizontal rows, each of said vertical columns comprising a minimum of 3 and a maximum of 11 squares, each of said horizontal rows comprising a minimum of 3 and a maximum of 7 squares, said game board comprising two square areas consisting of 9 squares each, designated as Safety zones, at the two ends of the said game board and an area consisting of 31 squares, located between the said Safety zones, comprising a Combat zone, said playing pieces comprising one set of light colored pieces and a set of dark colored pieces, adapted to be arranged within said Safety zones in the initial position for the game, each set comprising a selection of conventional chess pieces excluding the Pawns, said playing pieces not exceeding in number the number of squares in said Safety zones.

10. A chess-like game in accordance with claims 1, 7, 8 or 9, wherein said game board has letters and numbers printed inside the squares to indicate the relative position of the squares on the said game board.

11. A chess-like game in accordance with claims 1, 7, 8 or 9, wherein said game board has letters and numbers printed along the edges of the game board to indicate the relative position of the squares on said game board.

* * * * *